United States Patent [19]

Starkey

[11] 4,375,176

[45] Mar. 1, 1983

[54] KEYBOARD LATCH FOR ELECTRONIC ORGAN

[75] Inventor: David T. Starkey, Oak Park, Ill.

[73] Assignee: Norlin Industries, Inc., White Plains, N.Y.

[21] Appl. No.: 156,359

[22] Filed: Jun. 4, 1980

[51] Int. Cl.[3] ..... G10H 1/00

[52] U.S. Cl. ..... 84/1.01; 84/1.03; 84/1.24; 84/DIG.2

[58] Field of Search ..... 84/1.01, DIG. 23, 1.03, 84/1.24, DIG. 2; 340/365 C, 365 R

[56] References Cited

U.S. PATENT DOCUMENTS

| | | | |
|---|---|---|---|
| 3,781,450 | 12/1973 | Nakajima | 84/1.01 |
| 4,055,103 | 10/1977 | Machanian | 84/DIG. 23 |
| 4,214,500 | 7/1980 | Adachi et al. | 84/1.01 |
| 4,234,784 | 11/1980 | Totterdell | 340/365 C |
| 4,240,317 | 12/1980 | Kmetz | 84/1.01 |

*Primary Examiner*—J. V. Truhe
*Assistant Examiner*—Forester W. Isen
*Attorney, Agent, or Firm*—Ronald J. Kransdorf; Jack Kail

[57] ABSTRACT

An electronic organ having a scanned keyboard manual (10) includes a keyboard latch (24) interposed between the scanning apparatus (12) and the organ keyers (26). The keyboard latch (24) comprises a gate (42) for comparing the serial data pulses, each of which represents a respective depressed key, produced at the output of the scanning apparatus (12) during each scan of the keyboard manual (10) with the serial data pulses produced during the immediately preceding scan for developing a control signal representing the detection of a depressed keyboard key during the on-going scan which was not depressed during the immediately preceding scan. An output circuit (52, 54, 56) is provided for continuously developing an output signal reflecting the keys depressed during the last scan in which a control signal was developed whereby the tone signals corresponding thereto are continuously sounded even though the keys have subsequently been released.

9 Claims, 7 Drawing Figures

KEYBOARD LATCH FOR ELECTRONIC ORGAN

BACKGROUND OF THE INVENTION

The present invention relates generally to electronic keyboard musical instruments and, in particular, to an electronic organ in which the data representing one or more depressed keys can be latched for continuously producing corresponding output tones until at least one new key is depressed thereby freeing the hands of the player for operating other portions of the organ.

A keyboard musical instrument such as an electronic organ typically includes an upper or solo keyboard manual, a lower or accompaniment keyboard manual, a tone generator, and a plurality of keyers coupling the tone generator to a voicing circuit which, in turn, is connected through an amplifier to a speaker. The keyers are operable in response to depressed keys on the keyboard manuals for supplying appropriate tone signals from the tone generator to the voicing circuit and amplifier for sounding through the speaker. In addition, modern day electronic organs frequently utilize a time multiplexing mode of operation wherein the keys of one or both of the keyboard manuals are repetitively scanned for developing time encoded serial data streams identifying the depressed keys of the respective keyboards. A demultiplexer subsequently decodes the data streams for enabling actuation of the appropriate keyers.

The lower keyboard manual of the organ is typically operated by the player for sounding a selected chord to accompany the melody played on the upper manual. In order to continuously sound a desired accompaniment chord on the lower keyboard manual, the player must normally maintain the appropriate keys depressed with his left hand for repetitively supplying the corresponding serial data stream to the demultiplexer and keyers. In the meantime, the player's right hand may be utilized to play the melody on the upper manual and to otherwise operate the organ, for instance, to change the registration thereof. Although the foregoing organ playing technique is normally considered acceptable, it is desirable in certain instances to free the player's left hand to assist his right hand while still sounding a desired accompaniment chord. For example, U.S. Pat. No. 4,147,085 to Robinson et al discloses an electronic organ having a control circuit actuated by a knee operated switch for preventing the data supplied to the demultiplexers from being updated at the end of each keyboard scan whereby the data consequently held in the demultiplexer is effective for causing corresponding tone signals to be sounded even though the associated keys are not depressed. This approach suffers from the attending inconvenience of coordinating the operation of the knee switch with the operation of the keyboard keys.

It is a primary object of the present invention to provide an electronic organ including means responsive only to the operation of the keys of a keyboard manual for enabling selected groups of one or more tone signals to be successively sounded for desired time intervals even though the associated keys are not continuously depressed thereby freeing a hand of the player for operating other portions of the organ.

SUMMARY OF THE INVENTION

According to the present invention, a keyboard latch circuit is interposed between the source of serial data pulses defining the depressed keys on the keyboard manual of an electronic organ and the keyers used to couple tone signals to the voicing circuit of the organ. The keyboard latch circuit is operable for comparing the serial data pulses produced during each scan of the keyboard with the serial data pulses of the immediately preceding scan for producing a control signal representing the detection of a depressed keyboard key during the current scan which was not depressed during the immediately previous scan. An output circuit is provided for continuously developing an output signal reflecting the keys depressed during the last scan in which a control signal was developed whereby the tone signals corresponding thereto are continuously sounded even though the keys are not physically depressed.

In one embodiment of the invention, the output circuit comprises a shift register connected for recirculating the serial data pulses defining the keys depressed during the last keyboard scan in which a control signal was developed. In response to the development of a control signal, the contents of the shift register are dumped and the current serial data pulses are loaded into the shift register and continuously recirculated therethrough until another control signal is developed.

In a second embodiment of the invention, the serial data pulses defining the keys depressed during the last keyboard scan in which a control signal was developed are stored in an output circuit which is updated in response to each subsequent control signal for storing the serial data pulses associated therewith.

DESCRIPTION OF THE PREFERRED EMBODIMENT

Figure 1:
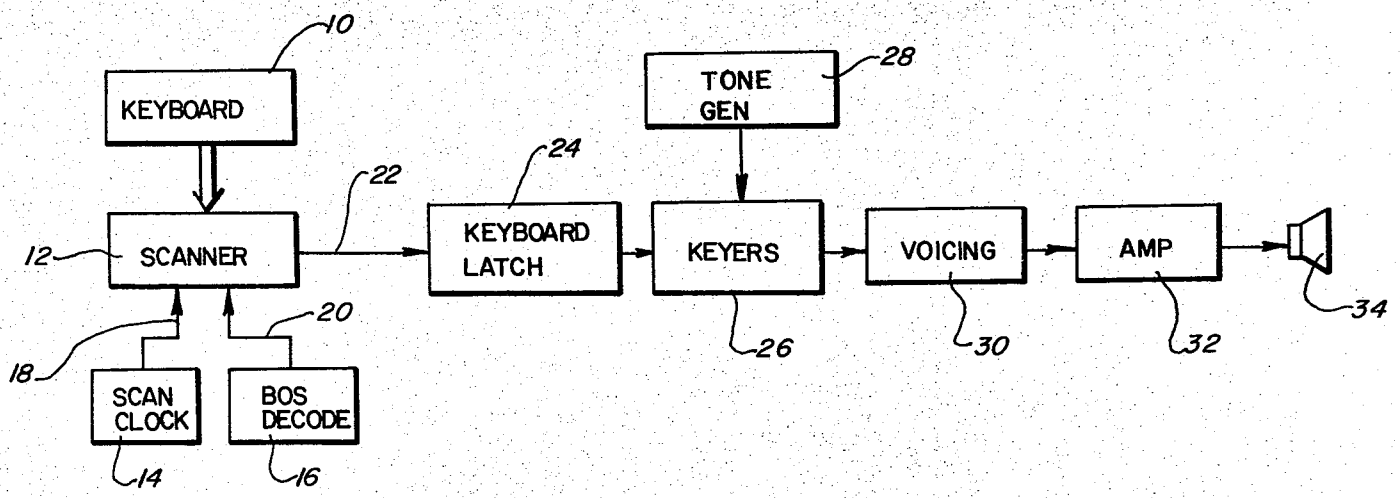
FIG. 1 is a block diagram showing the arrangement of a conventional electronic organ having a keyboard latch according to the present invention.

Referring to FIG. 1, which is a functional block diagram of an illustrative embodiment of the present invention, an electronic musical instrument such as an electronic organ includes a keyboard manual 10, a keyboard scanning apparatus 12, a scan clock 14 and a beginning of scan (BOS) decoder 16. While the invention is equally applicable to either the upper keyboard manual or the lower keyboard manual of an electronic organ and is intended to encompass such, it is presently envisioned that the largest degree of utility of the invention will be realized by associating the keyboard manual identified by reference number 10 in the drawings with the lower keyboard manual of the organ. The scanning apparatus 12 is a conventional and well known circuit operable in response to the output 18 of the scan clock 14 and the output 20 of the BOS decoder 16 for repetitively scanning the keyboard manual 10 for encoding the manual by a time division multiplexing scheme into a repetitive sequence of serial data streams. Each serial data stream corresponding to a single scan of the keyboard manual 10 consists of a plurality of time displaced data pulses appearing at the output 22 of the scanning apparatus 12 defining the depressed keys of the keyboard manual 10 during the scan. More particularly, each period of the scan clock signal defines a respective time slot corresponding to the note associated with a particular key of the keyboard manual 10. Thus, the development of a serial data pulse on the output 22 of scanning apparatus 12 coinciding with a certain period of the clock signal represents the depression of the key on the keyboard manual 10 having the corresponding note name.

The serial data pulses developed on the output 22 of the scanning apparatus 12, which define the depressed keys on keyboard manual 10, are coupled by the keyboard latch 24 of the invention to a plurality of keyers 26. The ones of keyers 26 actuated by the output of the keyboard latch 24 couple appropriate tone signals from a tone generator 28 to a voicing circuit 30 and an amplifier 32 for sounding through a speaker 34.

The keyboard latch 24 serves two main purposes in the circuit illustrated in FIG. 1. As will be explained in further detail hereinafter, the primary function of the keyboard latch 24 is to provide a facility whereby the keyers 26 may be operated for coupling selected tone signals from the tone generator 28 even though the corresponding keys of the keyboard 10 are not physically depressed. A secondary purpose of the keyboard latch 24 is to demultiplex the serial data pulses developed on the output 22 of the scanning apparatus 12 for application to the keyers 26.

Figure 2:
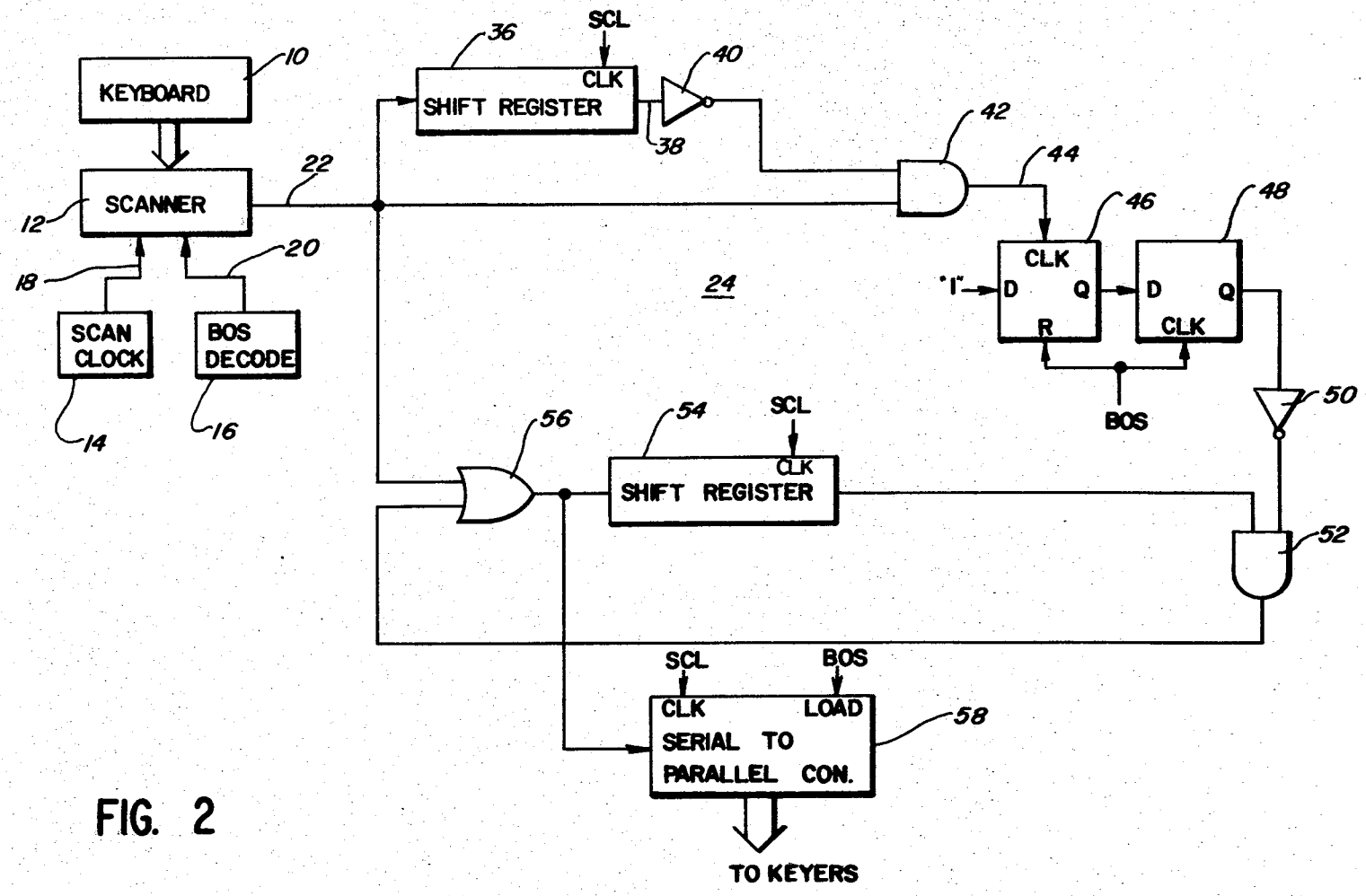
FIG. 2 is a block and logic diagram illustrating a first embodiment of the keyboard latch of the present invention.

A first embodiment of the keyboard latch 24 is shown in FIG. 2. The serial data pulses developed on the output 22 of the scanning apparatus 12 are coupled to the serial data input of a multiple stage shift register 36 which is clocked in response to the scan clock signal produced on the output 18 of the scan clock 14. The shift register 36 comprises a number of stages equal to the number of keys of the keyboard manual 10 so that the signal produced at the output 38 of the shift register corresponds to the serial data pulses developed on line 22 delayed in time by one complete scan of the keyboard manual 10.

The output 38 of the shift register 36 is coupled through an inverter 40 to the first input of an AND gate 42, the second input of AND gate 42 being connected directly to the output 22 of the scanning apparatus 12. AND gate 42 thusly functions for comparing the data pulses comprising each scan of the keyboard manual 10 with the data pulses developed during the immediately preceding scan. If the data pulses produced during the on-going scan of the keyboard manual 10 are identical with the data pulses produced during the immediately preceding scan or, if no data pulses are produced during the on-going scan (indicating that no keys have been depressed on the keyboard manual 10) the output 44 of the AND gate 42 will be logically low. However, if a key is depressed on the keyboard manual 10 which was not depressed during the immediately preceding scan, the output 44 of AND gate 42 will go logically high for the duration of the data pulse representing the newly depressed key. The resulting positive transition developed on the output 44 of AND gate 42 clocks a flip-flop 46 whose Q output is consequently driven to logical 1. A second flip-flop 48 has its D input terminal connected to the Q output of flip-flop 46 and is clocked in response to the BOS signal developed on the output 20 of BOS decoder 16, the BOS signal also being coupled to the reset input of flip-flop 46. Since the BOS signal comprises a narrow pulse occurring at the beginning of each keyboard scan, the Q output of flip-flop 48 is driven to logical 1 at the beginning of the scan immediately following the scan which caused the output 44 of AND gate 42 to go logically high. At the same time, flip-flop 46 is reset whereby the Q output of flip-flop 48 will go logically low in response to the next BOS pulse. Therefore, the Q output of flip-flop 48 is logically high during each scan following the scan in which a pulse is developed on the output 44 of AND gate 42 and is otherwise logically low.

The Q output of flip-flop 48 is connected through an inverter 50 to one input of a second AND gate 52. The second input to AND gate 52 is derived from the output of a second shift register 54 which is identical to shift register 36 and is also clocked in response to the output of the scan clock 14. The serial data input of the shift register 54 is connected to the output of an OR gate 56 whose two inputs are connected to the output 22 of scanning apparatus 12 and the output of AND gate 52. The output of the OR gate 56 is also coupled to the input of a serial to parallel converter 58 whose plural outputs are coupled for actuating the keyers 26.

It will be recalled that the Q output of flip-flop 48 is driven logically high during each scan of keyboard 10 following a scan in which a new key is depressed. The output of the inverter 50 is consequently logically low during this scan and disables the AND gate 52. Therefore, during this scan, the previous data stored in the shift register 54 is dumped onto its output and the shift register is reloaded in response to the scan clock signal with the sequence of data pulses representing the currently depressed keys. During the succeeding scan, the Q output of flip-flop 48 goes logically low and the output of inverter 50 goes logically high enabling the AND gate 52. The data stored in the shift register is therefore continuously recirculated around the path including the AND gate 52, the OR gate 56 and the shift register 54. The data will continue to so circulate until the Q output of flip-flop 48 again goes logically high when another new key has been depressed. It will be appreciated that the recirculating data therefore represents the keys depressed during the scan of keyboard 10 immediately following a scan during which the depression of a new key was detected and that this data will continue to recirculate even though the keys are released. The recirculating data is coupled to serial to parallel converter 58 which demultiplexes the serial information and develops one or more output signals for continuously actuating the keyers represented by the serial data. The foregoing sequence of events is repeated each time a key is depressed during a scan of the keyboard 10 which was not depressed during the immediately preceding scan.

Figure 3:
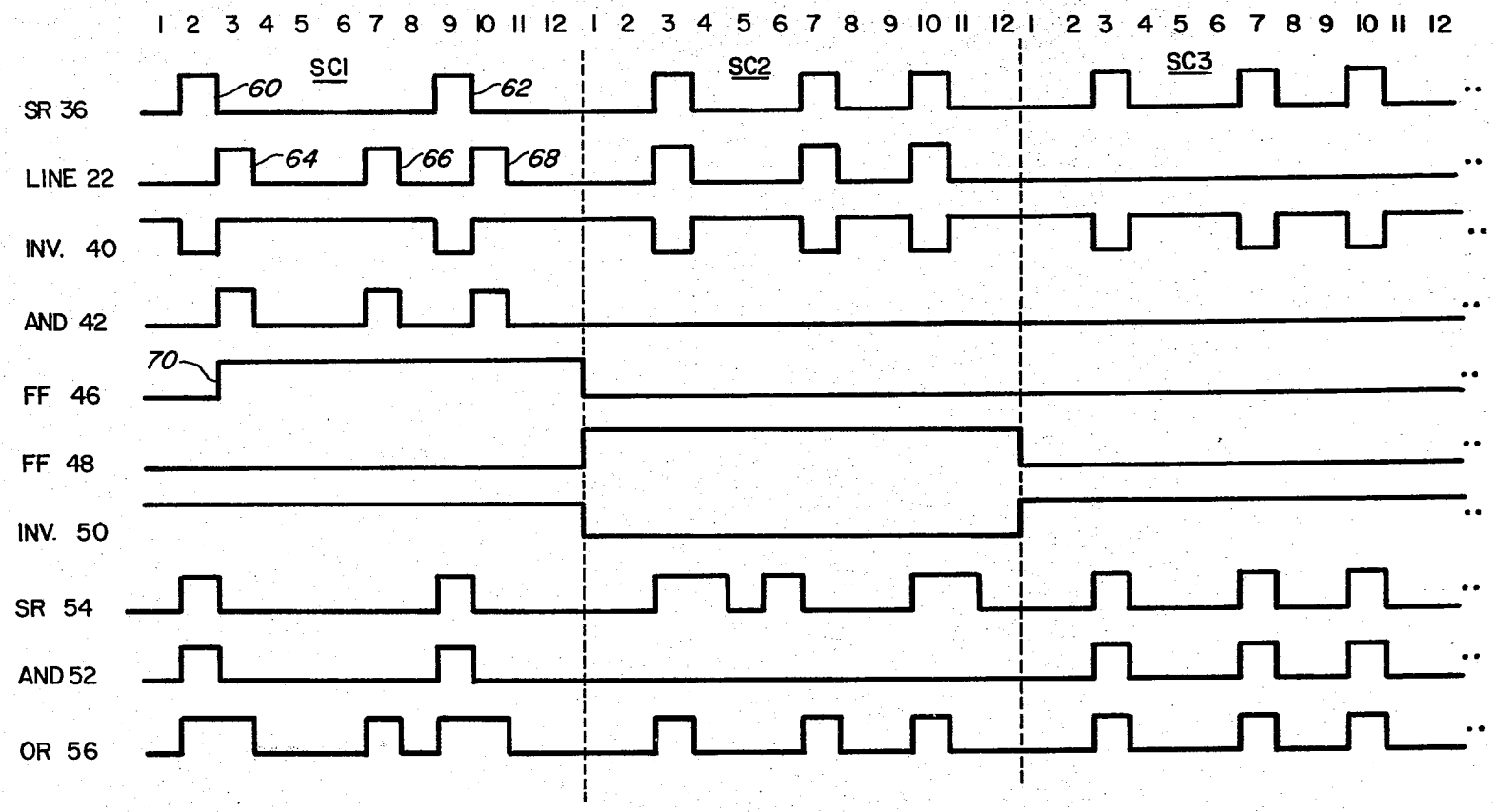
FIG. 3 shows various waveforms depicting the operation of the keyboard latch of FIG. 2.

The operation of the circuit of FIG. 2 is further illustrated by the waveform diagrams of FIG. 3. This figure illustrates three consecutive scans SC1, SC2 and SC3 of the keyboard manual 10, it being assumed that the keyboard comprises twelve keys so that each scan consists of twelve time slots. Also, it is assumed that both shift registers 36 and 54 are composed of twelve stages. In general terms, the waveform diagrams represent the following sequence of key depressions. During the scan immediately preceding scan SC1, the keys corresponding to time slots 2 and 9 were depressed (see output of shift register 36). During scans SC1 and SC2 the latter keys are released and the keys corresponding to time slots 3, 7 and 10 are depressed, these keys being released at the beginning of scan SC3 during which no keys are depressed. As will be explained below, this sequence of key depressions results in the organ continuously sounding the notes associated with the keys corresponding to time slots 3, 7 and 10 during scans SC2 and SC3 even though no keys are actually depressed during the latter scan. More particularly, during the initial scan SC1, the output of shift register 36 consists of pulses 60 and 62 occurring in time slots 2 and 9, which pulses represent the keys depressed during the scan immediately preceding scan SC1. The signal simultaneously developed on the output 22 of scanning apparatus 12 comprises three data pulses 64, 66 and 68 representing that the keys of keyboard manual 10 corresponding to time slots 3, 7 and 10 are being depressed during scan SC1. The outputs of inverter 40 and AND gate 42 are represented by the third and fourth waveforms of the figure. The initial positive transition of the output of AND gate 42, which represents the depression of a key during scan SC1 which was not depressed during the immediately preceding scan, causes the Q output of flip-flop 46 to go logically high at 70, this signal remaining logically high for the duration of scan SC1. The Q output of flip-flop 48 remains logically low during scan SC1 whereby the output of inverter 50 is logically high. The output of shift register 54 is consequently coupled through AND gate 52 whose output is combined with the data pulses on line 22 by OR gate 56 and coupled therefrom to converter 58.

During the next scan SC2, the output of shift register 36 is identical to the signal produced on output 22 of scanning apparatus 12 during the previous scan SC1. Due to the identity of the signals produced on line 22 and at the output of shift register 36, the output of AND gate 42 is continuously logically low. Also, at the beginning of scan SC2, flip-flop 46 is reset forcing its Q output logically low and flip-flop 48 is clocked to its logical 1 state. As a consequence, the output of inverter 50 goes logically low during the entire scan disabling AND gate 52. The contents of shift register 54, which corresponds to the output of OR gate 56 during scan SC1, is dumped onto the output of the shift register, the shift register being reloaded with the data currently developed at the output of OR gate 56.

During the next scan SC3 of keyboard 10, the signal developed on output 22 is continuously low representing that all of the keyboard keys have been released. The output of AND gate 52 remains logically low as does the outputs of flip-flops 46 and 48. The output of inverter 50 therefore is logically high and the data pulses representing the depression of the keys corresponding to time slots 3, 7 and 10 are recirculated through the shift register 54, the AND gate 52 and OR gate 56. This data will continue to recirculate even though all of the keys have been released until a new key is depressed. The recirculating serial data is coupled from the output of OR gate 56 to serial to parallel converter 58 which demultiplexes the serial data and actuates the keyers 26 for coupling the tone signals identified by the keys corresponding to time slots 3, 7 and 10 to the voicing circuit 30 and amplifier 32 for sounding by the speaker 34. These tone signals will be continuously produced until a new key is depressed as described above.

Figure 4:
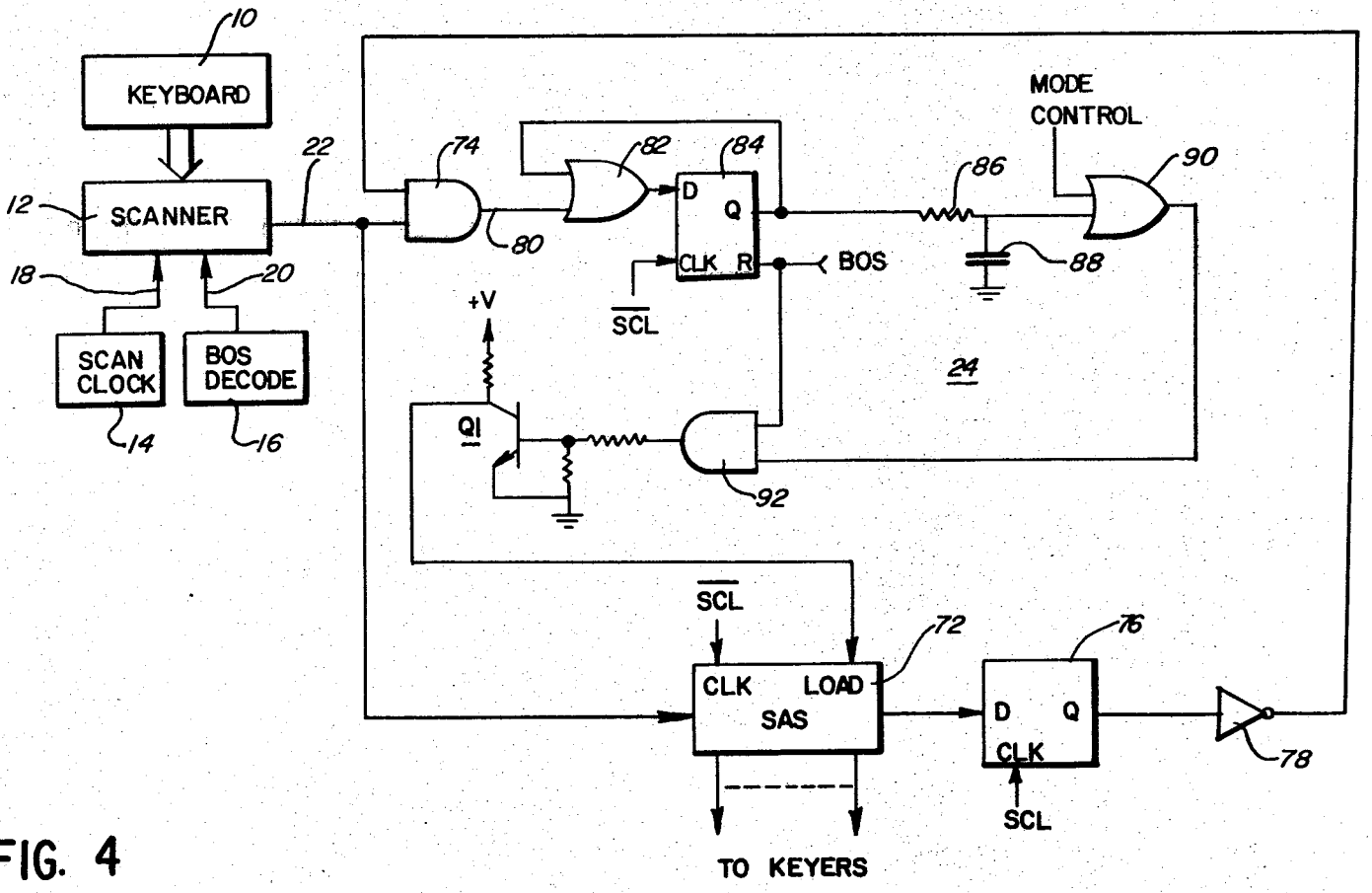
FIG. 4 is a block and logic diagram illustrating a second embodiment of the keyboard latch of the present invention.

FIG. 4 illustrates a second embodiment of the keyboard latch 24 which utilizes a single shift and store register 72 in lieu of shift registers 36 and 54 of FIG. 2 and does not require the use of serial to parallel converter 58 to demultiplex the serial data pulses. The shift and store register 72 may comprise, for example, National Semiconductor Part No. MM 5559 which is characterized by a pair of cascaded flip-flop chains. One of the cascaded flip-flop chains includes a serial data input, a clock input and a serial data output and operates as a conventional shift register. The other cascaded flip-flop chain includes a load input which when presented with a logical 0 signal latches the current content of the first flip-flop chain and presents such in parallel form at a plurality of outputs.

Turning to FIG. 4, the serial data pulses identifying depressed keys of the keyboard manual 10 and developed on the output 22 of scanning apparatus 12 are coupled to one input of an AND gate 74 and to the serial data input of shift and store register 72. The serial data pulses are shifted through the register 72 in response to the inverse of the scan clock signal and coupled from the output of register 72 to the D input of a flip-flop 76 clocked in response to the scan clock signal. Confidence in the proper operation of the register 72 is increased by clocking the register in response to the inverse of the scan clock signal as shown in the drawing. In particular, a positive transition of the inverse scan clock signal will coincide with the mid-point of any serial data pulse developed on output 22 insuring that the data pulse is suitably entered into the register. The flip-flop 76 is then employed to resynchronize the serial data output of the register 72 so that the positive transition of the pulses developed at the Q output of the flip-flop coincide with the positive transitions of the scan clock signal.

In view of the foregoing, it will be recognized that the signal produced at the output of flip-flop 76 corresponds to the serial data pulses developed on line 22 delayed in time by one complete scan of the keyboard manual 10. The delayed data pulses are inverted by an inverter 78 and coupled to the second input of the AND gate 74. AND gate 74 functions in a manner identical to AND gate 42 of FIG. 2 for comparing the data pulses comprising each scan of the keyboard manual 10 with the data pulses developed during the immediately preceding scan. And, as in the FIG. 2 embodiment, if the data pulses produced during the on-going scan of the keyboard manual 10 are identical with the data pulses produced during the immediately preceding scan or, if no data pulses are produced during the on-going scan, the output 80 of the AND gate 74 will be logically low. However, if a key is depressed on the keyboard manual 10 which was not depressed during the immediately preceding scan, the output 80 of AND gate 74 will go logically high for the duration of the data pulse representing the newly depressed key. This logically high signal is coupled through an OR gate 82 to the D input of a flip-flop 84. The Q output of flip-flop 84, which is clocked in response to the inverse of the scan clock signal, is fed back to the second input of OR gate 82 and also to the input of an RC circuit comprising a resistor 86 and a capacitor 88. Therefore, the Q output of flip-flop 84 is driven logically high in response to the development of a pulse at the output 80 of AND gate 74 in time coincidence with the positive transition of an inverse scan clock signal. The Q output of flip-flop 84, which remains logically high until the flip-flop is reset at the beginning of the next scan, charges the capacitor 88 through the resistor 86 for developing a logically high signal at the node common thereto.

The logically high signal developed at the output of the RC circuit is coupled to one input of an OR gate 90 whose second input is supplied with a binary mode control signal, the mode control signal being locigal 0 when the circuit of FIG. 4 is operating in its data latching mode. In this mode, the output of OR gate 90 goes logically high in response to the depression of a new key and remains logically high until the beginning of the next scan when flip-flop 84 is reset for discharging the RC circuit. Otherwise, the output of OR gate 90 is held logically low. The time constant of the RC circuit is selected to hold the output of OR gate 90 logically high for a sufficient time interval at the beginning of the next scan to allow an AND gate 92 to couple the associated BOS pulse to the base of a transistor Q1. Transistor Q1 inverts the BOS pulse which is then coupled to the load input of register 72 which is therefore operated for storing and coupling to keyers 26 the data pulses corresponding to the keys depressed during the preceding scan. To summarize the foregoing, a load pulse is developed at the output of transistor Q1 immediately after each scan in which a new key depression is detected for causing register 72 to store and couple to keyers 26 the data pulses corresponding to the keys depressed during that scan. The tone signals corresponding to the stored data signals will therefore be continuously sounded (even though no keys are depressed) until another new key is depressed, i.e. until a key is depressed during a scan which was not depressed during the immediately preceding scan.

When the mode control signal coupled to the second input of OR gate 90 is logical 1, AND gate 92 is effective for passing each and every BOS pulse to the base of transistor Q1. Consequently, a load pulse is developed at the beginning of each scan of the keyboard manual 10 thereby operating register 72 for successively storing and coupling to the keyers 26 the data pulses produced on the output 22 of scanning apparatus 12 during each respective scan of the keyboard. This mode of operation therefore provides conventional organ keying.

Figure 5:
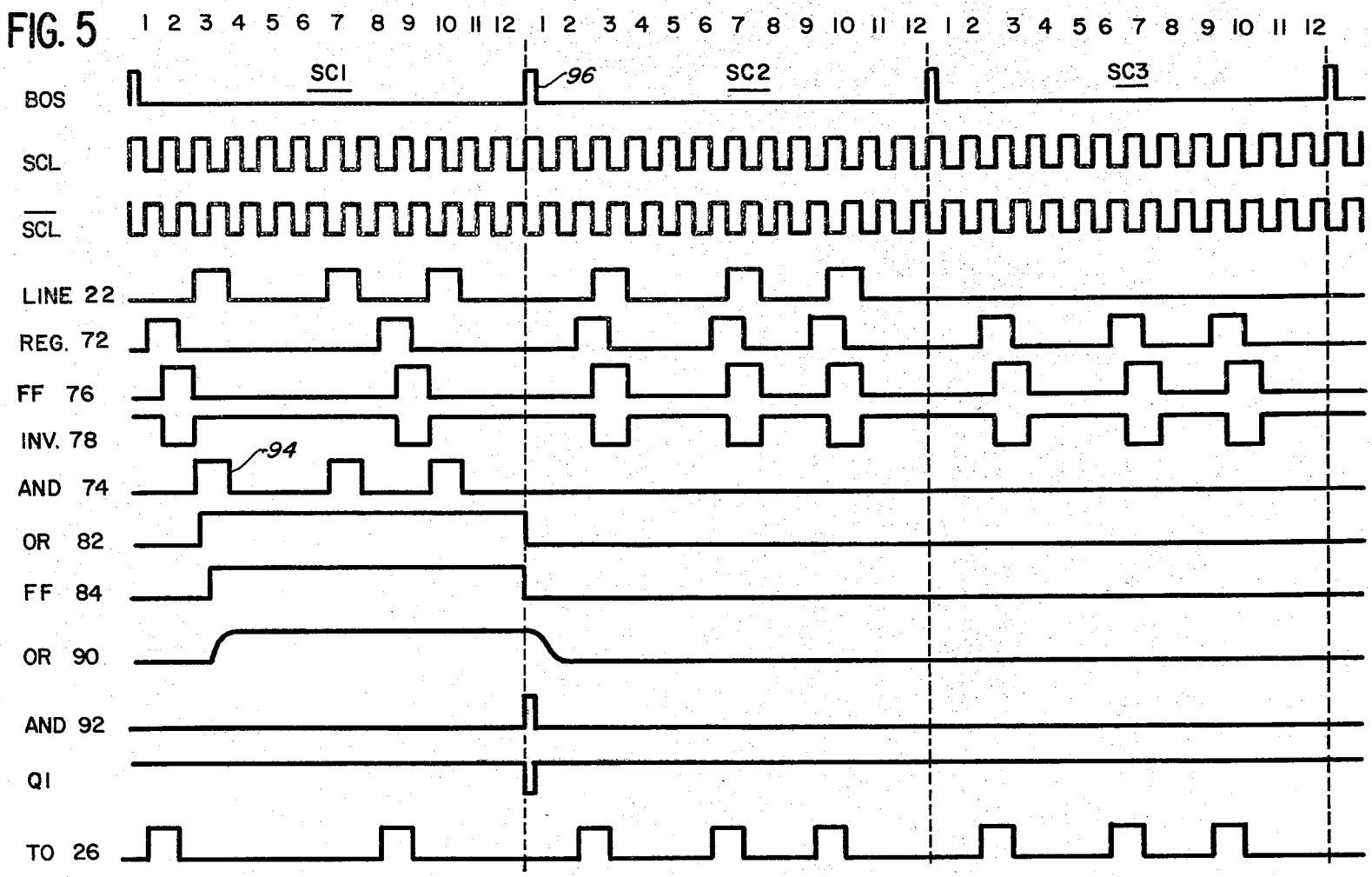
FIG. 5 shows various waveforms depicting the operation of the keyboard latch of FIG. 4.

The operation of the circuit of FIG. 4 is illustrated by the waveform diagrams of FIG. 5, which depicts a key depression sequence identical to that shown in FIG. 3. In particular, during the scan immediately preceding scan SC1 the keys of keyboard manual 10 corresponding to time slots 2 and 9 were depressed (as represented by the output of register 72) while the keys corresponding to time slots 3, 7 and 10 were depressed during scans SC1 and SC2. During the subsequent scan all of the keyboard keys were released as represented by the continuous logic 0 signal on output 22 of scanning apparatus 12. As explained in further detail below, this sequence of key depressions results in register 72 continuously actuating the keyers 26 for coupling tone signals from the tone generator 28 to the voicing circuit 30 associated with the keys corresponding to time slots 3, 7 and 10. These tone signals will be continuously produced during scans SC2 and SC3 and scans subsequent thereto until, at some later time, a new key is depressed.

Referring now in detail to FIG. 5, it will be observed that a pulse 94 is produced at the output of AND gate 74 during scan SC1 representative of the depression of a key during the scan which was not depressed during the immediately preceding scan. Pulse 94 is coupled through OR gate 82 and enables the Q output of flip-flop 84 to go logically high in coincidence with the next occurring positive transition of the inverse scan clock signal. The logically high outputs of OR gate 82 and flip-flop 84 will persist until the end of scan SC1 when flip-flop 84 is reset by a BOS pulse. The logically high signal at the Q output of flip-flop 84 will also cause capacitor 88 to charge through resistor 86 causing the output of OR gate 90 to go logically high thereby enabling AND gate 92.

At the beginning of scan SC2, the BOS pulse 96 resets flip-flop 84 causing its output as well as the output of OR gate 82 to go logically low. In response thereto, capacitor 88 begins discharging but holds the output of OR gate 90 logically high long enough to allow the BOS pulse 96 to be coupled through AND gate 92 to the base of transistor Q1. Transistor Q1 inverts the BOS pulse, the inverted pulse being coupled to the load input of register 72. Register 72 consequently stores and couples to the keyers 26 the key down data corresponding to time slots 3, 7 and 10.

During the subsequent scans of the keyboard manual 10, AND gate 92 is disabled since no new key depressions are detected by AND gate 74. Therefore, no load pulses are developed at the output of transistor Q1 and the key down data corresponding to time slots 3, 7 and 10 is continuously applied by the register 72 to the keyers 26.

It will be observed that the parallel outputs of register 72 coupled to the keyers 26 are not synchronized to the positive transistions of the scan clock signal. This may be corrected by interposing a flip-flop clocked by the scan clock signal between each output of the register 72 and its associated keyer 26 similar to the connection of flip-flop 76 between the serial data output of the register 72 and inverter 78.

Figure 6:
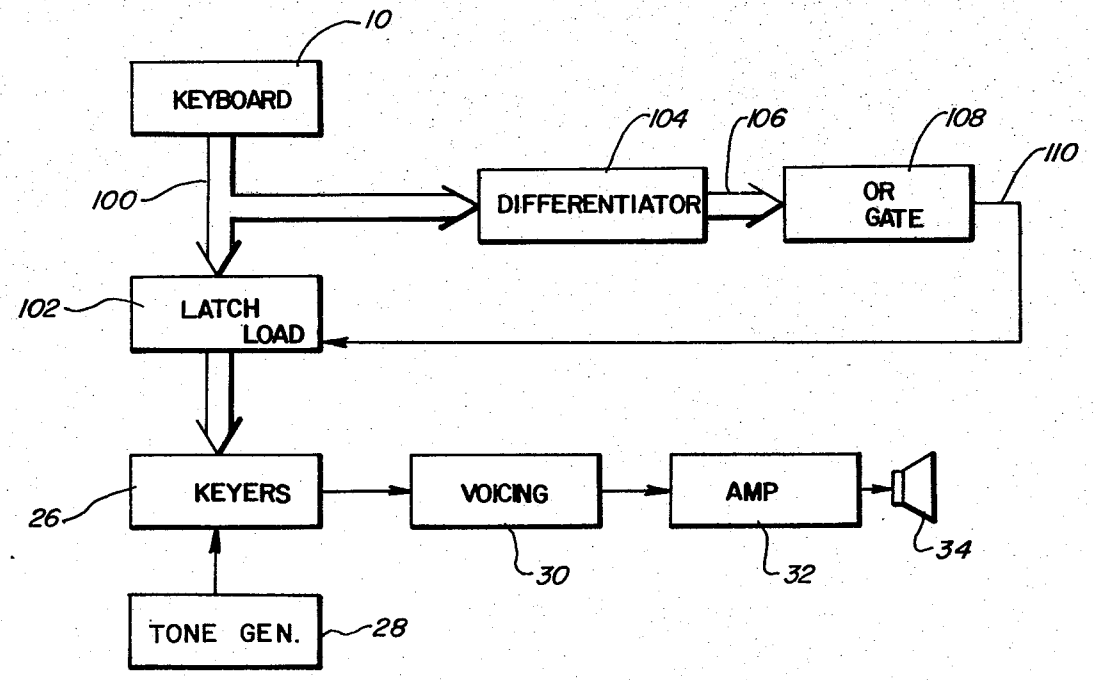
FIG. 6 is a block diagram illustrating a further embodiment of the keyboard latch of the invention used in an organ having a keyboard manual which is not scanned.
Figure 7:
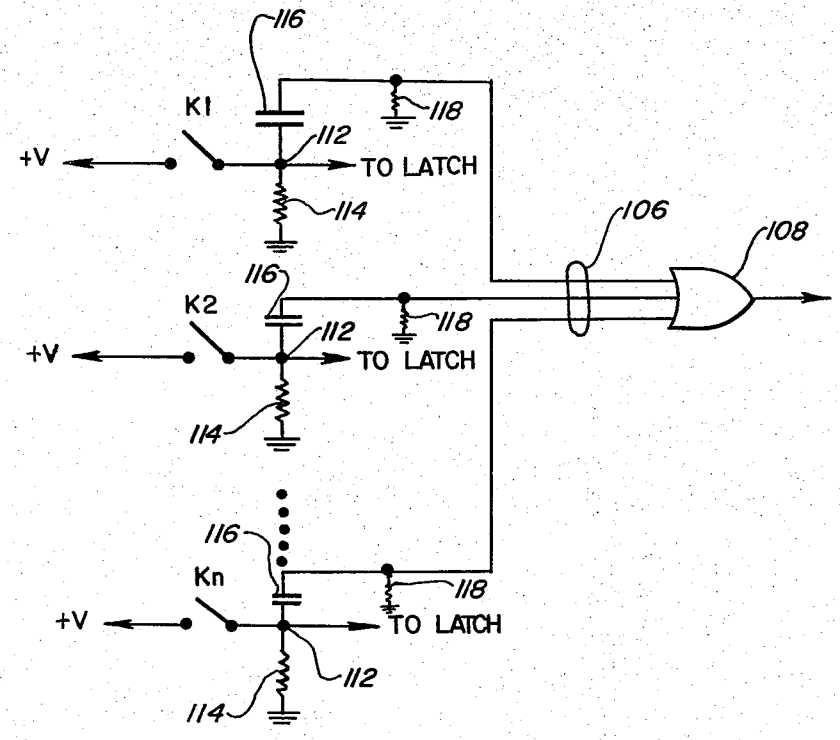
FIG. 7 is a schematic diagram illustrating one form of a differentiating circuit useful in the circuit of FIG. 6.

FIG. 6 illustrates an embodiment of the invention which may be used with an organ not having a scanned keyboard. In this embodiment, each key of the keyboard manual 10 includes an associated key switch $K_1$–$K_n$ which develops a logically high output signal in response to depression of its respective key (see FIG. 7). The output of each of the key switches is coupled by one line of a multiconductor bus 100 to a respective stage of a latch 102 and also to the input of one of a plurality of differentiating circuits 104. The output of each of the differentiating circuits 104 is, in turn, coupled by a multiconductor bus 106 to one input of an OR gate 108, the output of OR gate 108 being coupled to the load input of the latch 102. The outputs of latch 102 are coupled to the keyers 26 for controlling the tone signals coupled to the voicing circuit 30 as previously described. FIG. 7 illustrates an exemplary embodiment of the differentiating circuits 104. It will be observed that the output of each of the key switches $K_1K_n$ is connected to the node 112 formed between a resistor 114, whose other end is connected to ground, and a capacitor 116, the other terminals of capacitors 116 each being connected through a resistor 118 to ground and to one of the lines forming bus 106.

In operation, in response to the depression of one or more of the key switches $K_1$–$K_n$ a logically high signal is coupled to the associated node 112 which supplies a respective stage of latch 102. The signal developed at the node 112 is also differentiated by a resistor 114 and a capacitor 116 and coupled over one of the lines of bus 106 as a narrow pulse to the input of OR gate 108. A narrow pulse is consequently developed on line 110 causing the latch 102 to store the logically high signals characterizing the nodes 112 of all currently depressed keys. The latch 102 will continue to store this data even though the depressed keys are released actuating the keyers 26 for continuously coupling the corresponding tone signals from the tone generator 28. Subsequently, the next time one or more keys are depressed another load pulse is developed causing the latch 102 to store the data reflecting this new pattern of key depression for actuating the keyers 26, and so on.

While particular embodiments of the present invention have been shown and described, it will be apparent that changes and modifications may be made therein without departing from the invention in its broader aspects. The aim of the appended claims, therefore, is to cover all such changes and modifications as fall within the true spirit and scope of the invention.

I claim:

1. In an electronic musical instrument having a keyboard including a plurality of keys, a clock signal source developing a scan clock signal and means responsive to said scan clock signal for repetitively scanning said keyboard for repetitively developing a sequence of serial data pulses time encoded for defining depressed keys of said keyboard, the improvement comprising:

means generating a beginning of scan pulse defining the beginning of each of said repetitive keyboard scans;

means responsive to said clock signal for delaying and inverting each of said sequences of data pulses by the time required for said scanning means to complete one scan of said keyboard;

means responsive to said scanning means and to said means for delaying and inverting for developing a control signal in response to each scan of said keyboard during which at least one key is depressed that was not depressed during the scan occurring immediately prior thereto; and means responsive to each of said control signals and to the beginning of scan pulse generated immediately subsequent thereof for continuously developing an output signal representing the keys depressed during the scan of the keyboard resulting in the development of the respective one of said control signals and for maintaining said output signal until another key is depressed which was not depressed during the scan of the keyboard resulting in the development of said respective one of said control signals.

2. The improvement according to claim 1 wherein said means for delaying comprises shift register means having a serial data input connected for receiving said sequences of serial data pulses and a serial data output and inverting means coupled to said serial data output, means for inverting said scan clock signal, said shift register means being clocked in response to said inverted scan clock signal, and means connected in circuit with said serial data output for developing said delayed sequences of data pulses in a form synchronized with said scan clock signal.

3. The improvement according to claim 2 wherein said means for developing said delayed sequences of data pulses comprises flip-flop means clocked in response to said scan clock signal and having a data input connected to said serial data output of said shift register means.

4. The improvement according to claim 1 wherein said control signal developing means comprises means detecting coincidence between the logic levels of a pulse of one of said sequences of data puses and the signal corresponding to said inverted and delayed sequences of data pulses and bi-stable means responsive to said beginning of scan pulses for developing a gating signal having a first logic level during each scan of said keyboard immediately following a scan in which a condition of coincidence was detected by said coincidence detecting means and otherwise having a second logic level.

5. The improvement according to claim 4 wherein said output signal developing means comprises means responsive to said gating signal for recirculating the serial data pulses developed by said scanning means during each scan of said keyboard during which said gating signal assumed said first logic level for so long as said gating signal is characterized by said second logic level.

6. The improvement according to claim 5 wherein said means for recirculating comprises AND gate means having one input connected for receiving said gating signal, OR gate means having a first input connected to the output of said scanning means and a second input connected to the output of said AND gate means and shift register means having a serial data input connected to the output of said OR gate means and a serial data output connected to a second input of said AND gate means, said shift register means being clocked in response to said scan clock signal.

7. A method of playing an electronic organ having a keyboard including a plurality of keys which are repetitively scanned, each scan producing a sequence of serial data pulses time encoded for defining the keys depressed during the associated scan, the improvement in said method comprising:

delaying each of said sequences of data pulses by the time required to complete one scan of said keyboard;

inverting each of said delayed sequences of data pulses;

comparing each of said sequences of data pulses with the corresponding sequence of delayed and inverted data pulses for detecting the depression of one of said keys which was not depressed during the scan occurring immediately prior thereto; and developing an output signal continuously representing the keys depressed during each scan of said keyboard in which the depression of a key was detected which was not depressed during the scan occurring immediately prior thereto by recirculating the sequence of serial data pulses produced during each such scan of said keyboard.

8. In an electronic musical instrument having a keyboard including a plurality of keys, each of said keys including an associated output switch continuously developing a first logic signal in response to depression of the respective key, the improvement comprising:

a plurality of differentiating means each connected to a respective one of said key switch outputs and OR gate means having a plurality of inputs each connected to the output of a respective one of said differentiating means for developing a control signal in response to each depression of any one of said keys; and means responsive to each of said control signals for continuously developing an output signal representing all of the keys depressed at the time when the respective one of said control signals was developed.

9. The improvement according to claim 8 wherein said output signal developing means comprises a multi-stage latch, each stage of said latch being connected to a respective one of said key switch outputs, said latch including a load input connected to the output of said OR gate means.

* * * * *